United States Patent [19]

Forster et al.

[11] Patent Number: 4,593,261

[45] Date of Patent: Jun. 3, 1986

[54] DEVICE FOR COOLING A MAGNET SYSTEM

[75] Inventors: Helmut Forster; Karl-Georg Heinzelmann, both of Neunkirchen; Horst Siebold; Jürgen Vetter, both of Erlangen, all of Fed. Rep. of Germany

[73] Assignee: Siemens Aktiengesellschaft, Munich, Fed. Rep. of Germany

[21] Appl. No.: 696,105

[22] Filed: Jan. 29, 1985

[30] Foreign Application Priority Data

Feb. 8, 1984 [DE] Fed. Rep. of Germany ..... 3404457

[51] Int. Cl.[4] ..... H01F 5/00

[52] U.S. Cl. ..... 335/300; 335/299

[58] Field of Search ..... 335/300, 299; 336/57, 336/60, 62; 324/318, 319, 320

[56] References Cited

U.S. PATENT DOCUMENTS 3,295,082 12/1966 Kustom et al. ..... 335/300 X 3,305,810 2/1967 Webb ..... 335/300

*Primary Examiner*—George Harris

*Attorney, Agent, or Firm*—Kenyon & Kenyon

[57] ABSTRACT

A device for cooling a magnet system, especially in an installation for nuclear spin tomography which magnet system comprises several annular magnet coil windings which are made of ribbons of normal conducting material and are connected at their end faces over a large area to cooling elements in a heat conducting manner, the cooling elements cooled by a cooling medium flowing in coolant lines under forced flow. To assure an effective and reliable cooling of the coil windings on each end face of a magnet coil winding, a predetermined number of identically designed cooling elements uniformly distributed in the circumferential direction is cemented on, each cooling element comprising at least a heat conduction plate of annular sector shape which is provided with a predetermined number of slots uniformly distributed in the circumferential direction and to which the coolant line is connected over several turns in a heat conducting manner.

14 Claims, 5 Drawing Figures

DEVICE FOR COOLING A MAGNET SYSTEM

BACKGROUND OF THE INVENTION

This invention relates to cooling devices in general and more particularly to an improved device for cooling a magnet system, especially in a nuclear spin tomography system.

Cooling devices for magnet systems such as are used in nuclear spin tomography apparatus, where the magnet system comprises several disc-shaped magnet coil windings which are made from ribbons of normal conducting material and are connected at their end faces over a large area to cooling elements in a thermally conducting manner and can be cooled by a coolant flowing under forced flow in its coolant lines are know. Such a cooling device is provided for a magnet system such as is indicated in the journal "Computer Tomography", Vol 1, (1981), pages 2 to 20 and, in particular, page 6.

In the field of medical diagnostics, image forming methods have been developed in which an image similar to an X-ray tomogram is constructed by computer or measurement analysis of integral resonance signals of nuclei such as protons from the spatial spin density and/or relaxation time distribution of a body to be examined. The corresponding method is called nuclear spin tomography or nuclear magnetic resonance tomography or also zeugmatography ("Nature", Vol. 242, 1973, pages 190 and 191). For nuclear spin tomography systems (Nuclear Magnetic Resonance Tomography Systems), a strong base field, on which the magnitude of the nuclear resonance signal depends, and which must meet stringent requirements as to its homogeneity, is desired. Thus, a corresponding magnet system should have a field deviation of less than 50 ppm in a spherical volume with a diameter of about 50 cm.

The magnetic base field of such a magnet system is generally generated by four or more rotationally symmetric coil windings which are made of normally conducting, electrically highly conductive material for field strengths of up to about 250 mT. For the design of these windings discs, known as Bitter coils, or tubular, internally cooled hollow conductors or a wide metal ribbon are available. If metal ribbon which may consist, for instance, of copper or aluminum, is used, high precision is combined with relatively low manufacturing costs. In the magnet system which can be seen from the literature reference mentioned at the outset, its four coil windings are made of such a metal ribbon of aluminum.

Since the electric power required for such coil windings for the mentioned field strength conditions is quite considerable and is converted practically completely into heat, Joule power in the order of 100 kW must be removed, at least in part, by appropriate cooling measures. The individual coil windings must not be excessively deformed so as not to degrade the homogeneity. Also temperature must not exceed certain limits in order to ensure technical safety, e.g., so to not destroy electric insulation. The requirement, therefore, exists that the temperature of the coil windings be kept highly stable, since otherwise magnetic field variation in space and time which degrade the image quality in nuclear spin tomography could occur.

The coil windings of the known magnet system have low thermal conductivity in the radial direction because, for instance, 100 to 300 turns of the wide metal ribbon are spaced from each other by a corresponding number of thin insulating layers. Effective cooling is, therefore, possible only from the end faces. In cases where the coil windings are used for nuclear spin tomography, such cooling measures should take only little space perpendicular to the end face so as not to collide with coil windings which are relatively closely adjacent. Furthermore, these measures must not protrude into the radial inside space since this space is required for gradient coils, high frequency coils and the body to be examined.

For cooling the individual coil windings of the known magnet system, a large, washer-shaped plate of aluminum is provided at both end faces of each winding; this plate contains pressed-in copper tubes through which water is conducted as the cooling medium under forced flow. Each plate with its tubular coolant lines, therefore, represents a cooling element. The two cooling elements of each winding are held on the respective end faces by means of mutual threaded connections. The thermal contact between the cooling element to the winding must be accomplished here via a permanently plastic compound, since cementing would tear because of the high temperature stresses between the end faces and the respective cooling element. The thickness of this compound, however, must be chosen relatively large so that the thermal resistance of this compound is accordingly high. With this fixation, the cooling elements can also travel on the winding so that the adjustment of the individual windings changes accordingly.

It is an object of the present invention to improve the cooling device described above in such a manner that the above-described difficulties are at least largely eliminated, i.e., an effective and secure cooling of the coil windings of metal ribbons is assured, so that these coil windings meet the requirements of nuclear spin tomopgraphy systems.

SUMMARY OF THE INVENTION

According to the present invention, this problem is solved by cementing, a predetermined number of identical cooling elements, uniformly distributed in the circumferential direction on each end face of a magnet coil winding. Each cooling element has at least one washer-like heat conduction plate which is provided with a predetermined number of slots uniformly distributed in the circumferential direction and by means of which the coolant line is connected in several turns in a heat conducting manner.

Due to the structuring of the cooling elements according to the present invention and to its predetermined number and the respective expansion in the circumferential direction, these elements should advantageously be made flexible enough so that they can be cemented directly to the end faces of the respective coil windings, since these coil windings are relatively stiff in the circumferential direction. Due to the temperature difference between the winding and rigid cooling elements such as found in the known design, mechanical stresses of such a magnitude that the cement would tear off could occur. According to the present invention, the cooling elements are, therefore, finely segmented in the circumferential direction. Therefore, there is no danger that the cemented joint can tear due to the heat-related differences of expansion between the winding and the cooling element. Only relatively small layer thicknesses of the adhesive are required here so that the thermal resistance between the cooling element and the winding is advantageously small. It is further an advantage in production that the cooling device can be constructed of several identical sector shaped cooling elements, and the space required toward the end face is very small.

DETAILED DESCRIPTION

The cooling device according to the present invention is to be provided particularly for a magnet system for use in an installation for nuclear spin tomography, of the type described in the literature reference "Computer Tomography" mentioned at the outset. The magnet system is composed here of several, for instance, four to six washer-shaped (i.e., annular) magnet coil windings which are aligned one behind the other along an axis. The individual coils are wound from wide ribbons of normally conducting material, such as copper or aluminum, the individual turns being separated by a thin layer of electrical insulation. The windings, therefore, have washer-shaped end faces, to which cooling devices according to the present invention can be attached. These cooling devices have a particularly designed cooling element, of which two different embodiments can be seen in FIGS. 1 to 4.

Figures 1, 2, 3, 4:
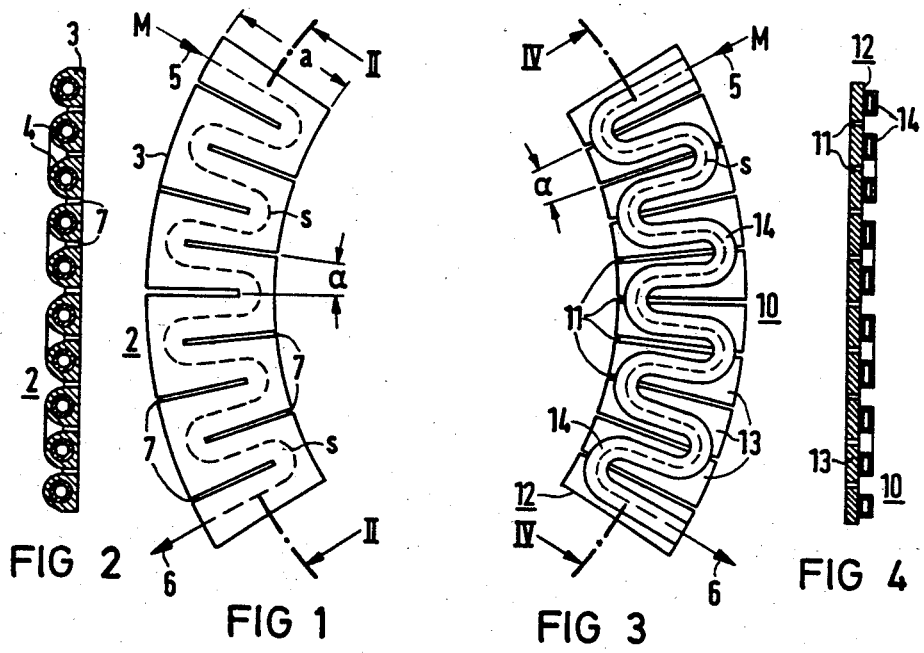
FIG. 1 is a top view through a cooling element of the cooling device according to the present invention.
FIG. 2 is a longitudinal section through FIG. 1.
FIGS. 3 and 4 are views similar to FIGS. 1 and 2 of a further embodiment of the present invention.

The cooling element 2 which is shown in the top view of FIG. 1 contains a heat conduction plate 3 which has the shape of an annular sector. This sector can occupy, for instance, 60 degrees of the entire circumferential arc of the cooling device, so that six such identical elements 2 can be arranged on the end face of the annular magnet winding, not shown in the Figure. Advantageously, at least four cooling elements are provided per end face. Thermally connected to the heat conduction plate 3 is a coolant line 4, which can be seen in detail only from FIG. 2, formed by, for instance, integrating this coolant line into the plate, especially by casting. Advantageously, a highly heat conductive material such as copper can be provided for this line. This line 4 advantageously has a sinusoidal or meander form. A coolant M such as water, an oil or flowing air of high velocity is conducted through it. The flow of this medium M through the line 4 and the direction of flow are indicated in FIG. 1 by a dashed line s and by arrows 5 and 6 at this line. In order to assure sufficient expansion of the heat conduction plate 3 and thereby of the entire cooling element 2 in the circumferential direction, the heat conduction plate 3 is provided with radial slots 7 which extend the regions defined by the individual turns of the coolant line 4 without leading directly to the coolant lines. In this manner, the heat conduction plate 3 is designed according to the form of the coolant line 4, wherein the coolant line 4 is always located in the solid material of the heat conduction plate 3. The number of slots 7 should be chosen so that the central arc angle $\alpha$ enclosed by adjacent slots is at most 20 degrees and preferably at most 10 degrees. According to the illustrated embodiment the heat conduction plate 3 is uniformly subdivided by nine slots so that $\alpha$ is 6 degrees. The radial dimension a of the cooling element 2 is not critical if the coil winding has a certain amount of residual softneses in the radial direction at its edge, since for fixing the aluminum ribbons within the coil winding, these ribbons need to be cemented to each other only at their center; i.e., at the lateral edges, a zone can advantageously be kept free, so that the respective edge of the coil winding can follow the thermal expansion of the cooling elements. Therefore, adhesives filled with $A_2O_3$ or quartz meal, for instance, with an epoxy resin base can be used for cementing down the cooling elements. These adhesives have sufficiently high thermal conductivity and are hard enough to make a further mechanical fixation of the cooling elements unnecessary.

Because the cooling elements, due to their structure according to the present invention, can adapt themselves to the respective end face, the layer thickness of the adhesive is influenced only by their manufacturing tolerance. Thus, layer thicknesses below 1 mm can be advantageously achieved. Since the layer must also provide electrical insulation, a minimum thickness must generally be assured. This purpose can advantageously be served by a porous fiberglass fabric for reinforcing the layer of the adhesive.

FIG. 2 is a longitudinal section through the cooling element 2 according to FIG. 1 which is taken along an arc-shaped sectional line desigated in this Figure as II—II. Parts of the cooling element identical with FIG. 1 are provided with the same reference symbols. From FIG. 2, the shape of the cross section of the coolant line 4 in particular can be seen.

Besides the design of the cooling elements 2, assumed in FIGS. 1 and 2, of copper tubing around which aluminum is cast, other tube profiles and other tube materials can, of course, also be used with recesses such that hollow spaces are formed when they are put together, into which the corresponding coolant line can be fitted or which form the coolant line directly. In addition, the profiles used as the coolant line also can be inserted into accordingly shaped recesses of a heat conduction plate, for instance, by cementing or pressing (see German Patent No. 32 13 093). The coolant line can further be made of thin sheet metal parts which are welded to the heat conduction plate in a form corresponding to the path of the coolant and are then deformed under pressure into the desired canal cross section (see DE-OS No. 31 12 194).

In FIGS. 3 and 4, a further embodiment of a cooling element for a cooling device according to the present invention is schematically illustrated in a top view and a longitudinal section of an arc -shaped sectional line designated as IV—IV through the cooling device according to FIG. 3 respectively. The cooling element 10 differs from the element 2 according to FIGS. 1 and 2 essentially only by the fact that the slots 11 in its heat conduction plate 12 extend over the entire radial dimension so that the heat conduction plate 12 is subdivided into a corresponding number of subsegments 13 of approximately equal size. To the heat conduction plate 12 which is thus made, for instance, of copper sheet, a coolant line 14 is then applied with a heat conducting connection. This coolant line can be, for instance, a square copper tube which is soldered to the subsegments 13 of the heat conduction plate 12. Instead of the assumed rectangular shape of these copper tube profiles, the coolant line may also have a different cross section, for instance, the shape of a ring. In addition, the cooling element 10 can also consists of other materials such as aluminum, by welding aluminum sections as of a coolant line 14 to aluminum sheet used as the heat conduction plate 12.

Figure 5:
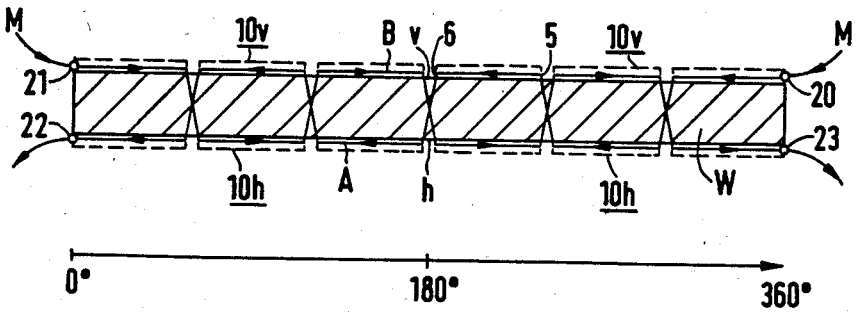
FIG. 5 is a schematic of the individual cooling elements of a cooling device according to the present invention for a coil winding.

For the annualar magnet coil windings which are to be provided with the cooling device according to the present invention, at least two mutually independent coolant streams running parallel or antiparallel are generally provided. It must be taken into consideration here that the two annular end faces of a coil winding can turn out to be different, i.e., their frontward and backward end faces can generally not be made ideally flat. This can have the result that the effectivness of the heat exchange between an end face and the cooling elements applied thereon is different from the heat exchange on the opposite end face. In order to keep the load of the two coolant streams the same as much as possible, they can be advantageously arranged alternating between the two sides. A corresponding schematic is shown in FIG. 5. For each of the frontward end face v and the rearward end face h of an annular magnet coil winding W indicated by hatching, six equal cooling elements according to FIGS. 1 or 3 can be provided. For making this clear, a development of the coil circumference into a plane was assumed in the Figure, the position of the individual cooling elements being associated with an arcuate angle plotted on a straight line for 360 degrees over the winding circumference. In addition, the cooling elements, for instance, according to FIG. 3, are indicated by dashed lines and are designated, dependent on their position on the front or rear end face of the coil winding W as 10 v and 10 h. The flow directions of the two mutually antiparallel coolant streams A and B are indicated by arrows. The coolant M of the two streams is fed in at inlet points 20 and 21 into the respective cooling devices and discharged at corresponding outlet points 22 and 23, respectively. As can be seen in FIG. 5, the respective coolant streams of two adjacent cooling elements lying on different end faces are opposite each other. Adjacent cooling elements on one end face likewise have coolant flows in opposite directions, where these coolant streams belong to the different cooling streams A and B.

In the illustrated embodiment for the cooling elements according to FIGS. 1 and 3, it was assumed that their coolant lines have sinusoidal or meander shape. Other designs, of course, are also possible as long as a thermal connection over a large area between the coolant lines and the respective heat conduction plates is assured. For this purpose, the coolant lines must in any case be connected thermally with the heat conduction plates over several turns. The coolant lines can, for instance, be applied to or worked into the respective thermal conduction plate in the form of one or more spirals.

What is claimed is:

1. A cooling device for a magnet system, which comprises several annular magnet coil windings made from ribbons of normal conducting material and having two annular end faces comprising, at each end face of said windings:

(a) a predetermined number of identical cooling elements uniformly distributed over the circumference of the end face, each cooling element comprising at least one heat conduction plate having the shape of an annular sector and provided with a predetermined number of slots uniformly distributed in the circumferential direction;

(b) a coolant line, adapted to conduct a forced flow of cooling medium, connected over several turns in a heat conducting manner to each heat conduction plate; and (c) adhesive cementing said cooling elements to the end faces of said coil windings over large areas in a heat conducting manner.

2. A cooling device according to claim 1, wherein said slots extend in the radial direction.

3. A cooling device according to claim 2, wherein the number of slots provided is such that the arcuate angle enclosed by adjacent slots is at most 20 degrees.

4. A cooling device according to claim 1, wherein said coolant lines have a sinusoidal or meander shape.

5. A cooling device according to claim 1, wherein the coolant lines are made in the form of a spiral.

6. A cooling device according to claim 1 wherein said coolant lines are worked into said respective heat conduction plates.

7. A cooling device according to claim 1 wherein the coolant lines are disposed on the respective heat conduction plates.

8. A cooling device according to claim 7, wherein said slots in said heat conduction plate extend over its entire radial dimension.

9. A cooling device according to claim 1 wherein two parallel or antiparallel coolant streams are provided at the respective two end faces of each magnet coil winding.

10. A cooling device according to claim 9, wherein opposite coolant flow directions are provided in the coolant lines of adjacent cooling elements on each end face.

11. A cooling device according to claim 10, wherein the coolant streams are alternatingly conducted to the cooling elements on opposite end faces of each magnet coil winding.

12. A cooling device according to claim 1, wherein at least four identically designed cooling elements per end face of the magnet coil winding are provided.

13. A cooling device according to claim 1, wherein the layer of adhesive between the cooling elements and the respective end face of the magnet coil winding is reinforced by means of a fiberglass fabric.

14. A cooling device according to claim 1 in combination with annular magnet coil windings, the ribbons of which are mutually cemented to form a compact winding only in a central region extending in the circumferential direction.

* * * * *